US005562058A

United States Patent [19]

Niino

[11] Patent Number: 5,562,058

[45] Date of Patent: Oct. 8, 1996

[54] REMOVABLE RUFFLER

[75] Inventor: Kumao Niino, Tokyo, Japan

[73] Assignee: Yugen Kaisha Niiken Kogyosho, Tokyo, Japan

[21] Appl. No.: 364,556

[22] Filed: Dec. 27, 1994

[30] Foreign Application Priority Data

Dec. 28, 1993 [JP] Japan ..... 5-076710 U

[51] Int. Cl.[6] ..... D05B 35/08

[52] U.S. Cl. ..... 112/134; 112/235

[58] Field of Search ..... 112/132, 133, 112/134, 135, 235, 240

[56] References Cited

U.S. PATENT DOCUMENTS

| | | | |
|---|---|---|---|
| 3,170,426 | 2/1965 | Micale | 112/240 |
| 3,203,383 | 8/1965 | Micale | 112/134 |
| 3,716,008 | 2/1973 | Howell | 112/240 |

*Primary Examiner*—Paul C. Lewis
*Attorney, Agent, or Firm*—Frishauf, Holtz, Goodman, Langer & Chick

[57] ABSTRACT

A removable ruffler for a sewing machine is removably mounted on the sewing machine by way of an exclusive removable holder of the sewing machine. A body of the ruffler for carrying out ruffling of a cloth has a ruffling member, a holder guide rail, and a presser foot guide rail, each extending in a transverse direction. A presser foot is mounted on the presser foot guide rail for sliding movement thereby pressing the cloth downward. A presser foot holder adjusts relative position of the presser foot and the body of the removable ruffler. The presser foot holder has longitudinal position adjustment portion abutting on the presser foot. The longitudinal position adjustment portion has an opening vertically formed therein and having a large longitudinal width. The presser foot holder also has a transverse position adjustment portion fitted on the holder guide rail. A longitudinal position-setting setscrew releasably fastens the longitudinal position adjustment portion and the presser foot together for adjusting a longitudinal position of the presser foot to a proper position, and for fixing the longitudinal position adjustment portion and the presser foot together in the proper position. A transverse position-setting setscrew releasably fastens the transverse position adjustment portion and the holder guide rail together, and for fixing the transverse position adjustment portion and the holder guide rail together.

7 Claims, 4 Drawing Sheets

REMOVABLE RUFFLER

BACKGROUND OF THE INVENTION

1. Field of the Invention

This invention relates to a removable ruffler which can be mounted on different exclusive removable holders for sewing machines.

2. Prior Art

Conventional removable holders are different in a mounting dimension $d_1$, as shown in FIG. 4, between the center c of a fitting groove 15 thereof through which an attachment screw 21 is screwed for fixing a removable holder to an attachment bar 20 of a sewing machine and a fitting groove 17 thereof for fitting a presser foot therein, according to sewing machine makers and models of sewing machines.

Therefore, when a particular ruffler is mounted on an exclusive removable holder provided for each sewing machine by way of a presser foot of the ruffler, a needle hole 23 of the sewing machine can be out of proper alignment with a needle hole **2*e* of the presser foot, a dimension $d_2$ between the center of a fitting pin 12 fit in the fitting groove 17 and the center of the needle hole 2*e* being fixed. That is, the needle hole 2*e* of the presser foot deviates in a forward or backward direction from its proper position into which the needle falls. In such cases, the needle is often broken because of the shifted position of the needle hole 2*e*** of the presser foot of the ruffler.

SUMMARY OF THE INVENTION

It is an object of the invention to provide a removable ruffler which can be properly mounted on any different exclusive removable holders, thereby improving the versatility of the removable ruffler and the stability of sewing operations performed by the use of the removable ruffler.

To attain the above object, the present invention provides a removable ruffler for a sewing machine for being removably mounted on the sewing machine by means of an exclusive removable holder of the sewing machine, comprising:

a body for carrying out ruffling of a cloth, the body having a ruffling member, a holder guide rail, and a presser foot-rail, each extending in a transverse direction;

a presser foot mounted on the presser foot guide rail for sliding movement, thereby pressing the cloth downward;

a presser foot holder for adjusting relative position of the presser foot and the body of the removable ruffler, the presser foot holder having longitudinal position adjustment means abutting on the presser foot, the longitudinal position adjustment means having an opening vertically formed therein and having a substantial longitudinal width, and transverse position adjustment means fitted on the holder guide rail;

longitudinal position-adjusting fastening means for releasably fastening the longitudinal position adjustment means and the presser foot together for adjusting a longitudinal position of the presser foot to a proper position, and for fixing the longitudinal position adjustment means and the presser foot together in the proper position; and transverse position-adjusting fastening means for releasably fastening the transverse position adjustment means and the holder guide rail together, thereby fixing the transverse position adjustment means and the holder guide rail to each other.

In a preferred embodiment of the invention, the transverse position adjustment means of the presser foot holder has an opening having a substantial transverse width, the transverse position-setting fastening means releasably fastening the transverse position adjustment means and the holder guide rail together for adjusting a transverse position of the presser foot to a proper position, and for fixing the transverse position adjustment means and the holder 15 guide rail together in the proper position.

Advantageously, the presser foot is divided into an upper half for being fitted in the exclusive holder and a lower half having a needle hole formed therethrough for permitting a needle of the sewing machine to pass therethrough.

Preferably, the lower half of the presser foot is fixed to the presser foot guide rail.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
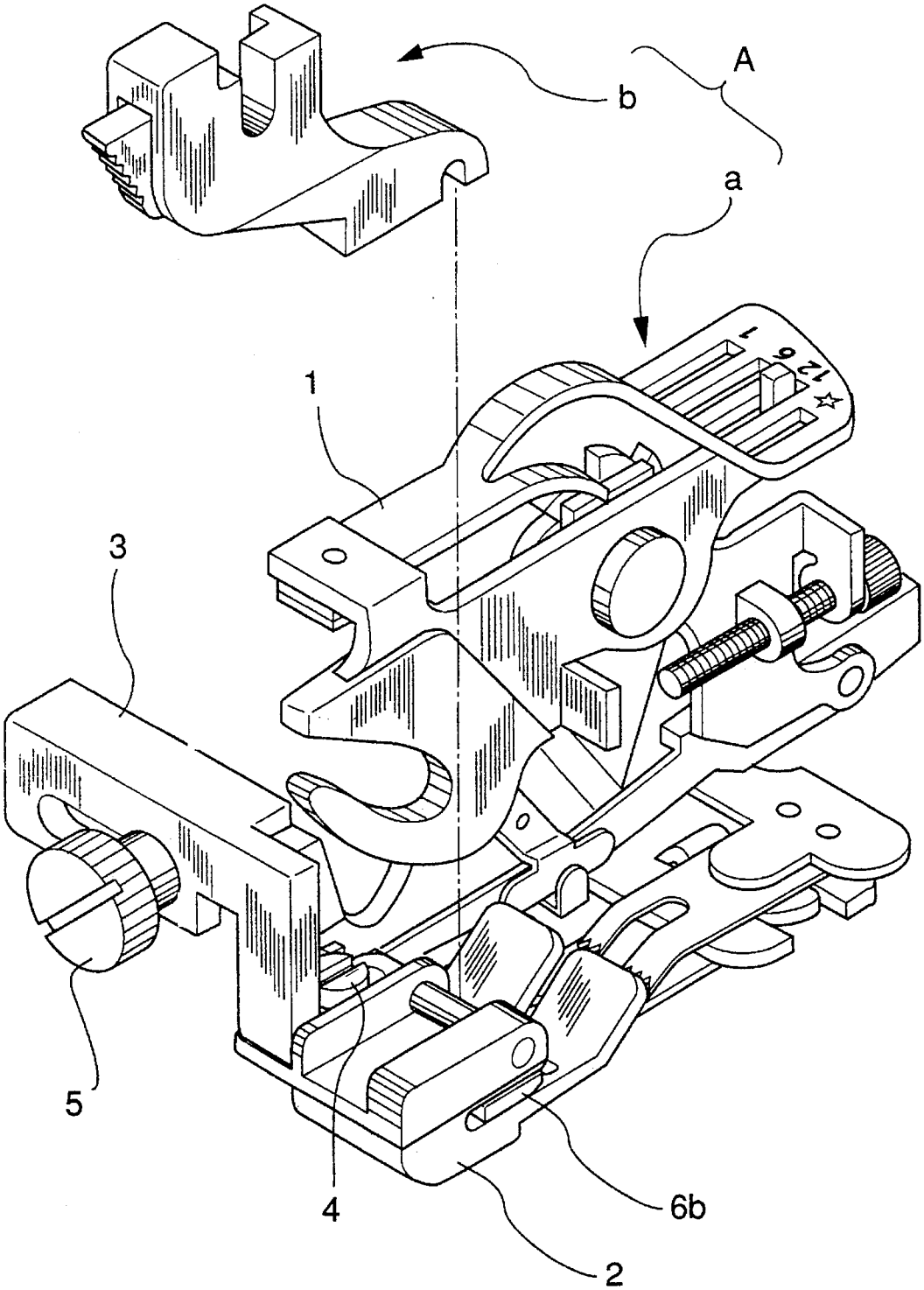
FIG. 1 is a perspective view of a ruffler assembly including a removable ruffler according to an embodiment of the invention.

Referring first to FIG. 1, there is shown a ruffler assembly for ruffling operations, in its perspective. In the figure, reference numeral A designates the ruffler assembly for ruffling operation, which is comprised of a ruffler a according to an embodiment of the invention and an exclusive holder b being an accessory of a sewing machine for removably mounting the ruffler to the sewing machine.

The ruffler a is comprised of a body 1, a presser foot 2, a presser foot holder 3, a longitudinal position-adjusting setscrew 4, and a transverse position-adjusting setscrew 5.

Figure 2:
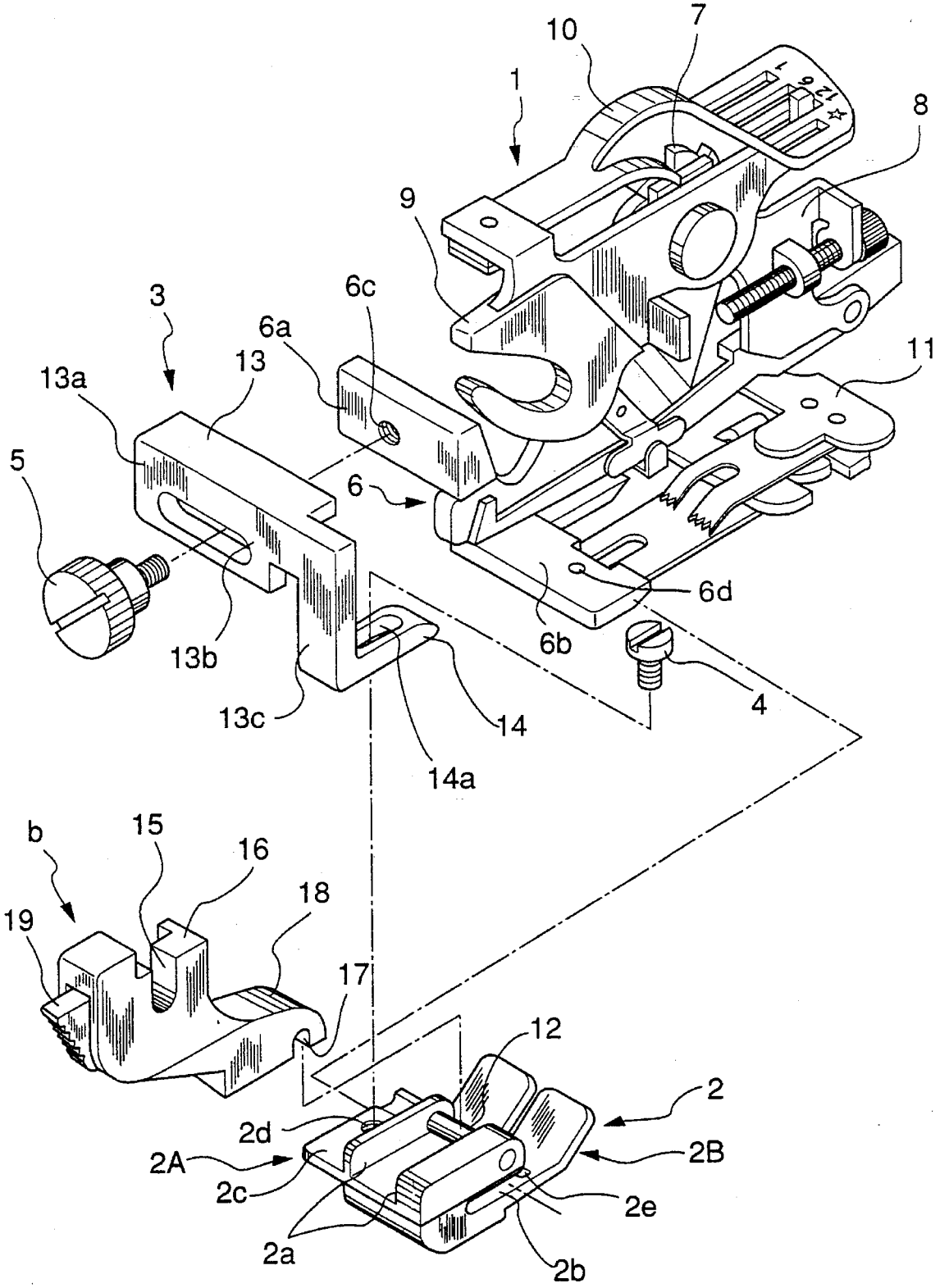
FIG. 2 is an exploded perspective view of the removable ruffler.

The body 1 is a unit or assembly, as shown in FIG. 2, which is comprised of a main frame 6, on an upper front left-side portion of which are rotatably mounted a ratchet gear 7, a connector plate 8, and a lever plate 9, a ratchet gear feed plate 10 which is assembled with the lever plate 9 for cooperation with the ratchet gear 7, and a ruffling member 11, a front end portion of which is rotatably mounted on a lower front right-side portion of the connector plate 8.

A guide rail **6*a* having a substantial vertical width is projected leftward from a tail end portion of the main frame 6, for slidably guiding the presser foot holder 3 in a transverse direction, while a presser foot guide rail 6*b* having a substantial horizontal width is projected rightward from the bottom of the tail end portion of the main frame 6. Reference numeral 6*c* designates a screw hole formed in the guide rail 6*a* into which the transverse position-adjusting setscrew 5** is screwed..

The presser foot 2 is comprised of an upper half 2A and a lower half 2B fabricated separately from each other. The upper half 2A is formed integrally with left-hand and right-hand ears or projections 2*a*, 2*a* which project from a common basis between which extends a fixture pin 12 on which the exclusive holder b is mounted. On the left side of the left-hand ear 2*a* stretches a flat guide surface 2*c* in a longitudinal direction. The guide surface 2*c* is formed therein with a screw hole 2*d* extending in a vertical direction for having the longitudinal position-adjusting setscrew 4 screwed therein. The upper half 2A has a smooth flat bottom surface.

The lower half 2B of the presser foot 2 has a recess 2*b* for being firmly fitted on the presser foot rail 6*b*. The lower half 2B is fixed to the presser foot guide rail 6*b* by a screw, not shown, screwed in a hole 6*d* of the guide rail 6*b* and a hole (not shown) formed in the lower half 2B, or by any other suitable means. Reference numeral 2*e* designates a needle hole formed through the lower half 2B of the presser foot 2. The lower half 2B has a smooth flat top surface.

The upper half 2A and the lower half 2B are in slidable contact with each other, whereby the lower half 2B can be moved at least in a longitudinal direction relative to the upper half 2A which is fixed to the exclusive holder b, as described above.

Although, in the present embodiment, the presser foot 2 is comprised of two separate parts, this is not limitative, but may have any construction insofar as it permits a shift of the needle hole 2*e* formed therein in the state of the presser foot being fitted in the exclusive holder b. For example, the presser foot may be constructed in one piece, similarly to conventional ones, and holes of the ears 2*a*, 2*a*, which receive the fitting pin 12, may be formed such that they are elongate in a longitudinal direction, and the longitudinal position of the fitting pin can be adjusted and fixed at a proper position along the elongate holes.

The presser foot holder 3 is formed by a fitting member 13 having a generally L-shaped longitudinal section, which is fit on the guide rail 6*a* for sliding movement in a transverse direction, and a fixture foot 14 which extends forward from the bottom of a leg 13*c* extending downward from a right end portion of a wall 13*a* of the fitting member 13. The fixture foot 14 is in slidable contact with the guide surface 2*c* for sliding movement in a longitudinal direction. The wall 13*a* of the fitting member 13 is formed with an elongate slot 13*b* extending therethrough in a longitudinal direction with a large transverse width. The aforementioned transverse position-adjusting setscrew 5 is inserted through the slot 13*b* to be screwed in the screw hole 6*c* formed in the guide rail 6*a*. Further, the fixture foot 14 is formed with a slot 14*a* extending therethrough in a vertical direction with a large longitudinal width. The upper half 2A of presser foot 2 is releasably fixed to fixture foot of presser foot holder 3 by means of longitudinal position-adjusting setscrew 4 extending through slot 14*a* formed through fixture foot 14 and screwed into screw hole 2*d* formed in guide surface 2*c* of upper half 2A. Alternatively, the presser foot holder 3 may be constructed such that the slot 13*b* is replaced by a circular hole through which the setscrew 5 is to be inserted, with the slot 14*a* remaining formed through the fixture foot 14 as in the illustrated example.

Figure 4:
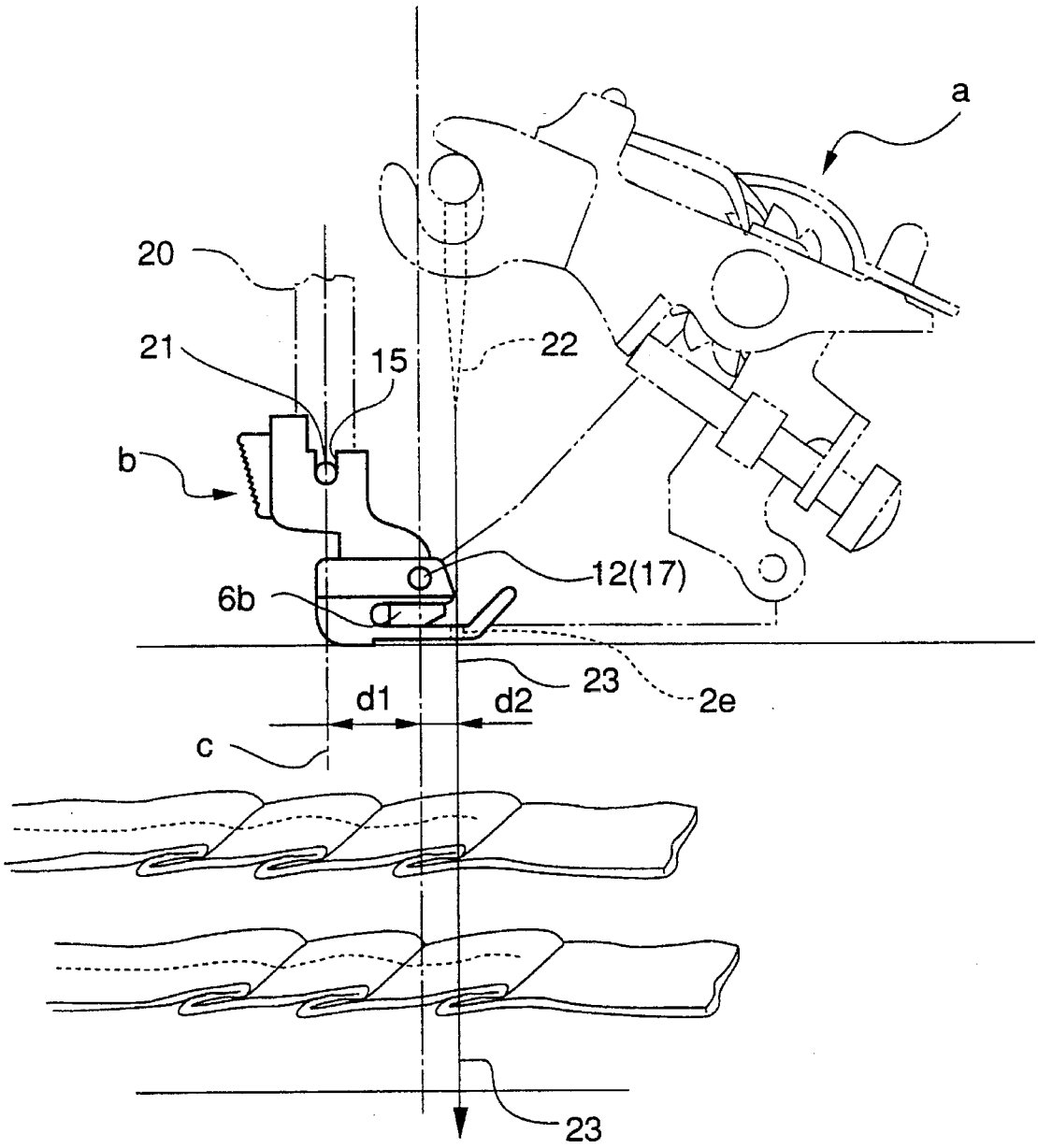
FIG. 4 is a side view of the removable ruffler in its mounted state.

The removable exclusive holder b is mounted on an attachment bar 20 (see FIG. 4) of the sewing machine as an exclusive accessory therefor which differs between sewing machine makers and models of sewing machines. The removable exclusive holder b is comprised of a fitting block 16 having a fitting groove 15 formed therein with an opening facing upward, for receiving a setscrew 21 (see FIG. 4) for fixing the removable exclusive holder b to the attachment bar 20, a holder body 18 continuously extending forward and downward integrally from the bottom of the fitting block 16, with a fitting groove 17 formed in a bottom surface thereof for having the fixture pin 12 fit therein, and a releasably-locking block 19 which operates to releasably lock the fitting pin 12 in the fitting groove 17 in a snap-fit manner. Referring to FIG. 4, in which reference numeral 22 design area a needle, the longitudinal distance $d_1$ between the center c of the fitting groove 15 and the center of the fitting groove 17 differs between different kinds of exclusive holders b. On the other hand, the distance between the center c of the fitting groove 15 and the position of the needle hole 23 of the sewing machine is fixed.

Next, the operation of the removable ruffler constructed as above will be described.

The position of the needle hole 2*e* of the presser foot 2 of the ruffler according to the invention can be adjusted in the state of the ruffler being mounted on the sewing machine by way of the upper half 2A of the presser foot through fitting the fitting pin 12 in the fitting groove 17 of the exclusive holder b in the following manner: If the position of the needle hole 2*e* deviates backward from its proper position in alignment with the position of the needle hole 23 of the sewing machine, the longitudinal position-adjusting setscrew 4 is loosened and then the whole ruffler except the upper half 2A of the presser foot 2 fixed to the sewing machine is moved forward to a position as indicated by the solid lines in FIG. 3. During the movement of the ruffler, the guide surface 2*c* slides forward along the fixture foot 14 together with the longitudinal position-adjusting setscrew 4 moving along the slot 14*a* in the same direction. When the needle hole 2*e* of the lower half 2B fixed to the presser foot guide rail 6*b* of the ruffler is brought to a point which is in alignment with the needle hole 23 of the sewing machine to which the position of the present removable ruffler should be adjusted, the movement of the ruffler is stopped, and then the longitudinal position-adjusting setscrew 4 is fastened, whereupon the guide surface 2*c* of the presser foot 2 abuts on the fixture foot 14, and the needle hole 2*e* of the presser foot and the needle hole 23 of the sewing machine become in alignment with each other within a proper tolerance, thereby completing the adjustment of the position of the needle hole 2*e* of the presser foot of the ruffler.

Figure 3:
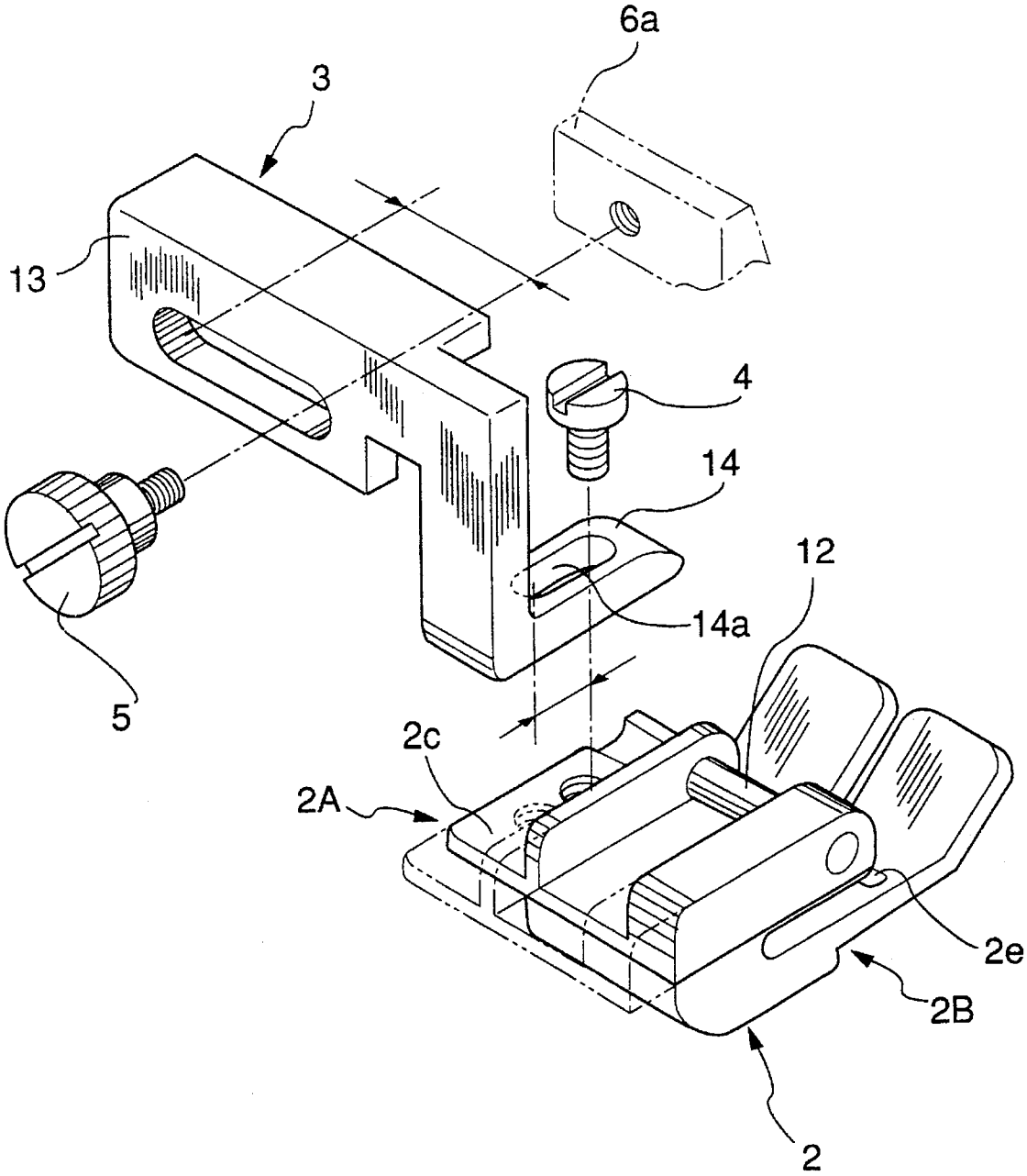
FIG. 3 is an exploded perspective view of essential parts of the removable ruffler, which is useful in explaining the operation of the removable ruffler.

On the other hand, when the position of the needle hole 2*e* of the presser foot 2 of the ruffler deviates forward from its proper position, the longitudinal position-adjusting setscrew 4 is loosened and the whole ruffler except the upper half 2A of the presser foot is moved backward to a position as indicated by the two-dot chain lines in FIG. 3. During the movement of the ruffler, the guide surface 2*c* slides backward along the fixture foot 14 together with the longitudinal position-adjusting setscrew 4, which moves along the slot 14*a* in the same direction. When the needle hole 2*e* is brought to a point which is in alignment with the needle hole 23 of the sewing machine to which the position of the present removable ruffler should be adjusted, the movement of the ruffler is stopped, and then the longitudinal position setscrew 4 is fastened. Thus, similarly to the above, the adjustment of position of the presser foot is connected.

Further, depending on whether the center line is positioned inward or outward relative to a surface of the attachment bar 20 on which the removable exclusive holder b is attached, the transverse position-adjusting setscrew 5 is loosened to slide the fitting member 13 of the presser foot holder 3 along the guide rail 6*a* in the-transverse direction up to a suitable position, where the setscrew 5 is fastened to fix the presser foot holder 3 to the guide rail 6*a*.

What is claimed is:

1. A removable ruffler for a sewing machine which is adapted to be removably mounted on said sewing machine by means of an exclusive removable holder of said sewing machine, comprising:

a body for carrying out ruffling of a cloth, said body having a ruffling member, a holder guide rail, and a presser foot guide rail, each extending in a transverse direction;

a presser foot for pressing said cloth downward, said presser foot being mounted on said presser foot guide rail with a part thereof mounted for sliding movement relative to said presser foot guide rail;

a presser foot holder for adjusting a relative position of said presser foot and said body of said removable ruffler, said presser foot holder having longitudinal position adjustment means abutting on said presser foot, said longitudinal position adjustment means having an opening vertically formed therein and having a substantial longitudinal width, and transverse position adjustment means fitted on said holder guide rail;

longitudinal position-adjusting fastening means for releasably fastening said longitudinal position adjustment means and said presser foot together for adjusting a longitudinal position of said presser foot to a proper position, and for fixing said longitudinal position adjustment means and said presser foot together in said proper position; and transverse position-adjusting fastening means for releasably fastening said transverse position adjustment means and said holder guide rail together, thereby fixing said transverse position adjustment means and said holder guide rail to each other.

2. A removable ruffler according to claim 1, wherein said transverse position adjustment means of said presser foot holder has an opening having substantial transverse width, said transverse position-adjusting fastening means releasably fastening said transverse position adjustment means and said holder guide rail together for adjusting a transverse position of said presser foot to a proper position, and for fixing said transverse position adjustment means and said holder guide rail together in said proper position.

3. A removable ruffler according to claim 1, wherein said presser foot is divided into an upper half for being fitted in said exclusive holder and a lower half having a needle hole formed therethrough for permitting a needle of said sewing machine to pass therethrough.

4. A removable ruffler according to claim 2, wherein said presser foot is divided into an upper half for being fitted in said exclusive holder and a lower half having a needle hole formed therethrough for permitting a needle of said sewing machine to pass therethrough.

5. A removable ruffler according to claim 3, wherein said lower half of said presser foot is fixed to said presser foot guide rail.

6. A removable ruffler according to claim 4, wherein said lower half of said presser foot is fixed to said presser foot guide rail.

7. A removable ruffler for a sewing machine which is adapted to be removably mounted on said sewing machine by means of an exclusive removable holder of said sewing machine, comprising:

a body for carrying out ruffling of a cloth, said body having a ruffling member, a holder guide rail, and a presser foot guide rail;

a presser foot for pressing said cloth downward, said presser foot being divided into an upper half for being fitted in said exclusive holder and a lower half fixed to said presser foot guide rail, said presser foot having a needle hole formed therethrough for permitting a needle of said sewing machine to pass therethrough, said upper half and said lower half being slidable relative to each other;

a presser foot holder releasably fixed to said holder guide rail for adjusting a relative position of said upper half of said presser foot and said body of said removable ruffler, said presser foot holder having longitudinal position adjustment means abutting on said upper half of said presser foot, said longitudinal position adjustment means having an opening vertically formed therein and having a substantial longitudinal width; and longitudinal position-adjusting fastening means for releasably fastening said longitudinal position adjustment means and said upper half of said presser foot together for adjusting a longitudinal position of said upper half of said presser foot to a proper position, and for fixing said longitudinal position adjustment means and said upper half of said presser foot together in said proper position.

* * * * *